US006453989B1

(12) United States Patent
Watanabe et al.

(10) Patent No.: US 6,453,989 B1
(45) Date of Patent: Sep. 24, 2002

(54) HEAT EXCHANGER

(75) Inventors: Yoshinori Watanabe; Akira Yoshikoshi, both of Nagoya; Atsushi Suzuki, Nishi-Kasugai-gun; Kiyoto Yasui, Nishi-Kasugai-gun; Hiroshi Iokawa, Nishi-Kasugai-gun; Hiroyuki Kotou, Nagoya; Shin Watabe, Nishi-Kasugai-gun; Masashi Inoue, Nishi-Kasugai-gun; Koji Nakado, Nishi-Kasugai-gun, all of (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/579,272

(22) Filed: May 26, 2000

(30) Foreign Application Priority Data

May 31, 1999 (JP) ..... 11-153022

(51) Int. Cl.[7] ..... F28F 1/00; F28F 1/14; F15D 55/00

(52) U.S. Cl. ..... 165/177; 165/183; 138/38

(58) Field of Search ..... 165/177, 183, 165/173, 153; 138/37, 38, 42; 29/890.053, 890.049

(56) References Cited

U.S. PATENT DOCUMENTS

| | | | | |
|---|---|---|---|---|
| 4,600,053 A | | 7/1986 | Patel et al. | |
| 5,101,891 A | | 4/1992 | Kadle | |
| 5,172,476 A | | 12/1992 | Joshi | |
| 5,409,056 A | | 4/1995 | Farry, Jr., et al. | |
| 5,560,425 A | * | 10/1996 | Sugawara et al. | 165/148 |
| 5,996,633 A | * | 12/1999 | Kato | 165/170 |
| 6,047,769 A | * | 4/2000 | Shimoya et al. | 165/153 |

FOREIGN PATENT DOCUMENTS

| | | |
|---|---|---|
| EP | 0 650 024 | 4/1995 |
| GB | 2 223 091 | 3/1990 |
| JP | 63-34489 | 2/1988 |

(List continued on next page.)

OTHER PUBLICATIONS

U.S. patent application Ser. No. 09/668,342, filed Sep. 25, 2000, pending.

(List continued on next page.)

*Primary Examiner*—Henry Bennett
*Assistant Examiner*—Tho V Duong
(74) *Attorney, Agent, or Firm*—Oblon, Spivak, McClelland, Maier & Neustadt, P.C.

(57) ABSTRACT

A heat exchanger is constructed by tubes, corrugated fins and head pipes, which are assembled together. Herein, the tube is constructed by bending a flat plate whose surfaces are clad with brazing material to form a first wall and a second wall, which are arranged opposite to each other with a prescribed interval of distance therebetween to provide a refrigerant passage. Before bending, a number of swelling portions are formed to swell from an interior surface of the flat plate by press. By bending, the swelling portions are correspondingly paired in elevation between the first and second walls, so their top portions are brought into contact with each other to form columns each having a prescribed sectional shape corresponding to an elliptical shape or an elongated circular shape each defined by a short length and a long length. The columns are arranged to align long lengths thereof in a length direction of the tube corresponding to a refrigerant flow direction such that obliquely adjacent columns, which are arranged adjacent to each other obliquely with respect to the length direction of the tube, are arranged at different locations and are partly overlapped with each other with long lengths thereof in view of a width direction perpendicular to the length direction of the tube. The tubes, corrugated fins and head pipes are assembled together and are then placed into a heating furnace to heat for a prescribed time.

1 Claim, 14 Drawing Sheets

FOREIGN PATENT DOCUMENTS

| | | | |
|---|---|---|---|
| JP | 2-28981 | | 2/1990 |
| JP | 3-155422 | | 7/1991 |
| JP | 8-327266 | | 12/1996 |
| JP | 9-42882 | | 2/1997 |
| JP | 1019494 A | * | 1/1998 |

OTHER PUBLICATIONS

U.S. patent application Ser. No. 09/900,947, filed Jul. 10, 2001, pending.

U.S. patent application Ser. No. 09/948,648, filed Sep. 10, 2001, pending.

U.S. patent application Ser. No. 09/948,773, filed Sep. 10, 2000, pending.

U.S. patent application Ser. No. 09/956,874, filed Sep. 21, 2001, pending.

U.S. patent application Ser. No. 09/977,426, filed Oct. 16, 2001, pending.

* cited by examiner $P_1$=4.5 $d_1$=3.0
$P_2$=3.65 $d_2$=6.1
$P_1/d_1 \fallingdotseq 1.5$
$P_2/d_2 \fallingdotseq 0.6$ $P_1$=4.5 $d_1$=3.0
$P_2$=7.0 $d_2$=6.1
$P_1/d_1 \fallingdotseq 1.5$
$P_2/d_2 \fallingdotseq 1.15$ $P_1$=6.0 $d_1$=3.0
$P_2$=7.0 $d_2$=6.1
$P_1/d_1 \fallingdotseq 2.0$
$P_2/d_2 \fallingdotseq 1.15$ $P_1$=3.8 $d_1$=3.0
$P_2$=7.0 $d_2$=6.1
$P_1/d_1 \fallingdotseq 1.27$
$P_2/d_2 \fallingdotseq 1.15$

HEAT EXCHANGER

BACKGROUND OF THE INVENTION

1. Field of the Invention

This invention relates to heat exchangers which are applicable to air conditioners particularly used for vehicles. In addition, this invention also relates to methods of manufacturing the heat exchangers.

This application is based on Patent Application No. Hei 11-153022 filed in Japan, the content of which is incorporated herein by reference.

2. Description of the Related Art

In general, heat-exchanger tubes are used for heat exchangers which are installed in air conditioners of vehicles, for example. The heat-exchanger tubes are mainly classified into two types of tubes (or pipes), which are shown in FIGS. 19 and 20 respectively.

FIG. 19 shows an example of a so-called "seam welded tube", which is designated by a reference numeral "1". That is, the seam welded tube 1 is constructed by a tube 2 having a flat shape and a corrugated inner fin 4. Herein, the corrugated inner fin 4 is inserted into the tube 2 by way of its opening 3. The corrugated inner fin 4 is formed in a corrugated shape having waves whose crest portions "4*a*" are bonded to an interior surface of the tube 2 by welding, or the like.

FIG. 20 shows an example of an extrusion tube, which is designated by a reference numeral "5". The extrusion tube 5 has tube portions "6" and partition walls "7", which are integrally formed by extrusion molding.

If a heat exchanger is designed using the seam welded tube 1 shown in FIG. 19, it has an advantage in which since the corrugated inner fin 4 is inserted into the tube 2, an overall heating area is enlarged to improve a heat transfer rate. However, there is a disadvantage in which manufacturing such a heat exchanger needs much working time in insertion of the corrugated inner fin 4 into the tube 2 and welding of the corrugated inner fin 4 being bonded to the interior surface of the tube 2. This causes a problem in which the manufacturing costs are increased by the need for human effort.

If a heat exchanger is designed using the extrusion tube 5 shown in FIG. 20, it has an advantage in which, since the partition walls 7 are formed to partition an inside space of the extrusion tube 5 into multiple tube portions 6, an overall heating area is enlarged to improve a heat transfer rate. The extrusion tube 5 is manufactured using an extrusion molding technique. So, it is difficult to make the tube portions 6 sufficiently small, and it is difficult to make the thickness of the partition walls 7 sufficiently thin. In addition, the extrusion molding technique needs an increasing amount of materials used for formation of the extrusion tube 5, so that manufacturing costs are increased. Further, it is impossible to improve heat-exchange capability so much due to the relatively large thickness of the partition walls 7.

SUMMARY OF THE INVENTION

It is an object of the invention to provide a heat exchanger that is improved in pressure strength and heat-exchange capability without increasing manufacturing costs significantly.

It is another object of the invention to provide a method for manufacturing the heat exchanger.

A heat exchanger is constructed by tubes, corrugated fins and head pipes, which are assembled together. Herein, the tube is constructed by bending a flat plate whose surfaces are clad with brazing material to form a first wall and a second wall, which are arranged opposite to each other with a prescribed interval of distance therebetween to provide a refrigerant passage. Before bending, a number of swelling portions are formed by pressing to extend from an interior surface of the flat plate. By bending, the swelling portions are correspondingly paired in elevation between the first and second walls, so their top portions are brought into contact with each other to form columns each having a prescribed sectional shape corresponding to an elliptical shape or an elongated circular-shape each being defined by a short length and a long length. The columns are arranged to align long lengths thereof in a length direction of the tube corresponding to a refrigerant flow direction such that obliquely adjacent columns, which are arranged adjacent to each other obliquely with respect to the length direction of the tube, are arranged at different locations and are partly overlapped with each other with long lengths thereof in view of a width direction perpendicular to the length direction of the tube. The tubes, corrugated fins and head pipes are assembled together and are then placed into a heating furnace to heat for a prescribed time.

Because of the aforementioned arrangement and formation of the columns inside of the tube, it is possible to improve an overall heat transfer rate of the tube on the average, and it is possible to improve a pressure-proof strength with respect to the tube.

Incidentally, each of the columns has the prescribed sectional shape which is defined by a relationship of $$2.0 \le \frac{d2}{d1} \le 3.0.$$

In addition, using a first center distance p1 being measured between the obliquely adjacent columns in the width direction of the tube and a second center distance p2 being measured between the obliquely adjacent columns in the length direction of the tube, the columns are arranged inside of the tube to meet relationships of $$1.5 \le \frac{p1}{d1} \le 3.0 \text{ and } 0.5 \le \frac{p2}{d2} \le 1.5.$$

BRIEF DESCRIPTION OF THE DRAWINGS

These and other objects, aspects and embodiments of the present invention will be described in more detail with reference to the following drawing figures, of which.

DESCRIPTION OF THE PREFERRED EMBODIMENTS

This invention will be described in further detail by way of examples with reference to the accompanying drawings.

First Embodiment

Now, a heat exchanger will be described in accordance with a first embodiment of the invention with reference to FIGS. 1 to 13.

Figure 1:
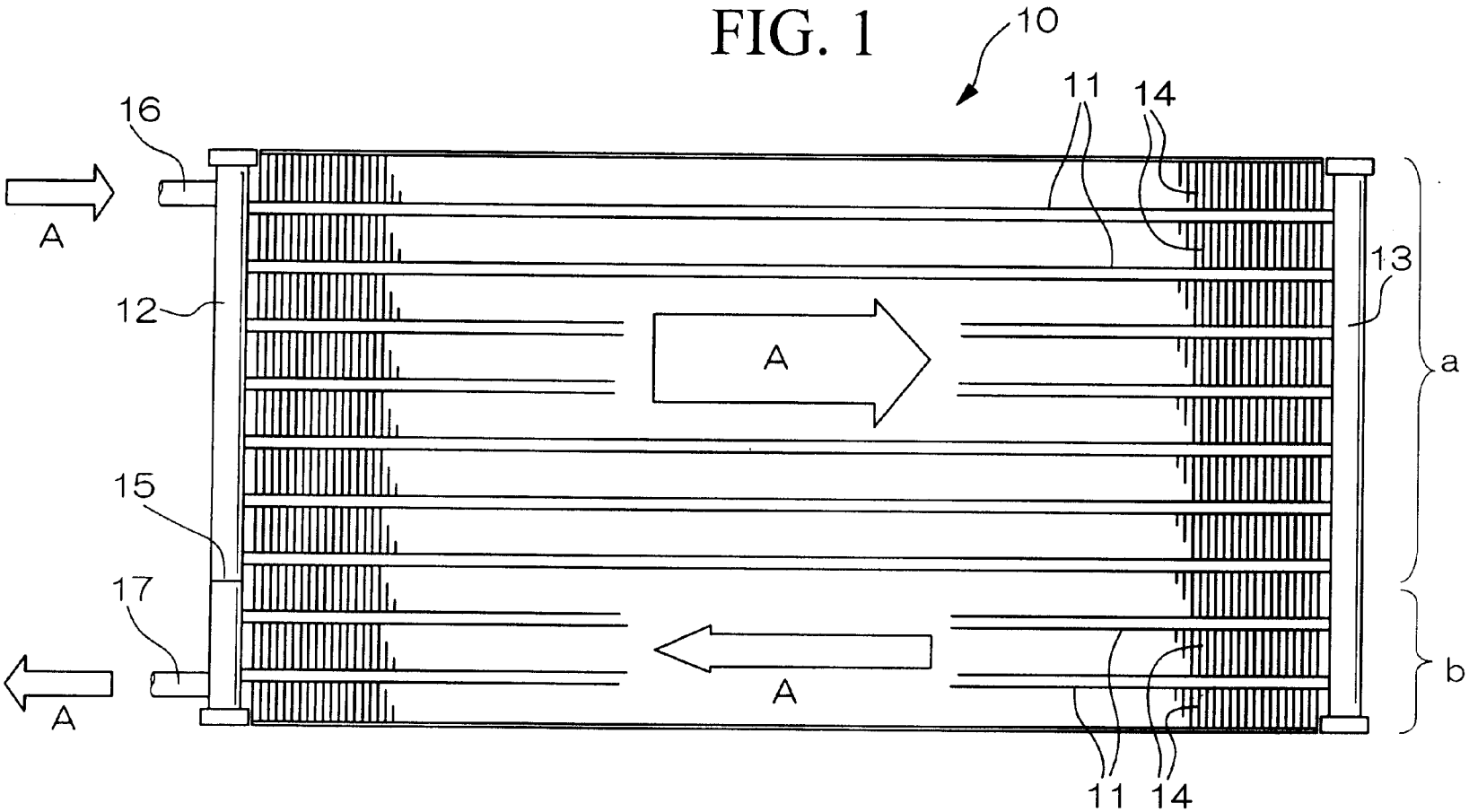
FIG. 1 is a front view showing a heat exchanger in accordance with a first embodiment of the invention.

FIG. 1 is a front view showing a heat exchanger 10, which is designed in accordance with the first embodiment of the invention. Herein, the heat exchanger 10 is constructed by tubes 11 each having a flat shape, a pair of head pipes 12, 13 and corrugated fins 14. The head pipes 12, 13 are arranged in contact with both ends of the tubes 11, wherein they communicate with refrigerant passages inside of the tubes 11 respectively. Each of the corrugated fins 14 is arranged between the tubes 11, wherein crest portions are brought into contact with the tubes 11.

An inside space of the head pipe 12 is partitioned into two sections (hereinafter, referred to as an upper section and a lower section) by a partition plate 15, which is arranged slightly below a center level of the head pipe 12. A refrigerant inlet pipe 16 is installed to communicate with the upper section of the head pipe 12, while a refrigerant outlet pipe 17 is installed to communicate with the lower section of the head pipe 12.

An overall front area of the heat exchanger 10 is divided into two areas (i.e., an upper area "a" and a lower area "b") by the partition plate 15. Refrigerant is introduced to flow in the tubes 11 in different directions (A) in connection with the two areas. With respect to the upper area "a", refrigerant flow in a direction from the head pipe 12 to the head pipe 13. With respect to the lower area "b", refrigerant flow in another direction from the head pipe 13 to the head pipe 12.

Figure 2:
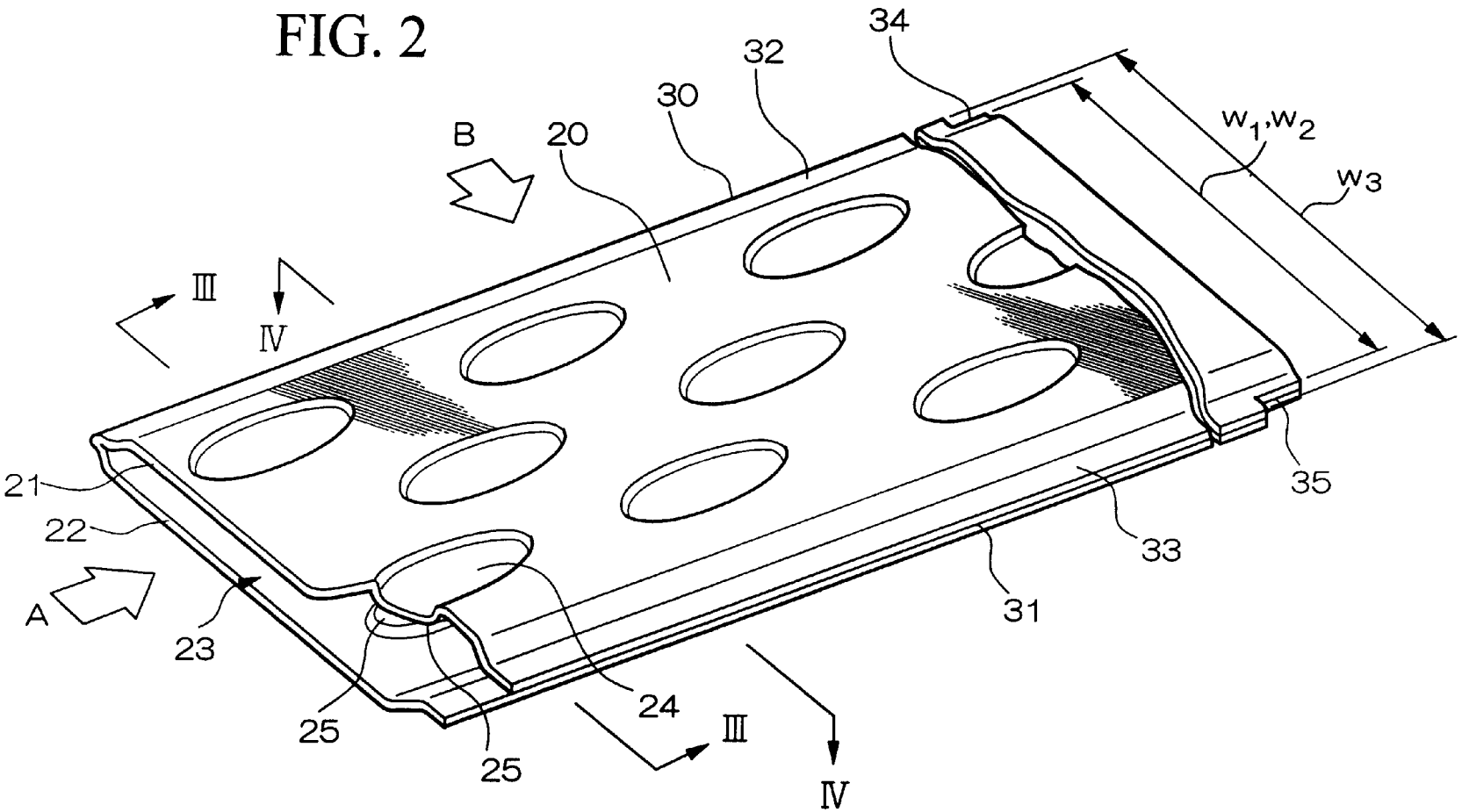
FIG. 2 is an enlarged perspective view showing a detailed construction of a tube which is an essential part of the heat exchanger of FIG. 1.

Each of the tubes 11 is constructed as shown in FIG. 2. That is, the tube 11 is made by bending a flat plate 20 to form a first wall 21 and a second wall 22, which are arranged opposite to each other and in parallel with each other. So, a refrigerant passage 23 is formed in a space being encompassed by the walls 21, 22.

A number of dimples 24 are formed on exterior surfaces of the tube 11 and are made by applying external pressures to the walls 21, 22 to cave in at selected positions. Because of formation of the dimples 24, a number of swelling portions 25 are correspondingly formed to swell from interior surfaces of the tube 11 within the refrigerant passage 23.

Figure 3:
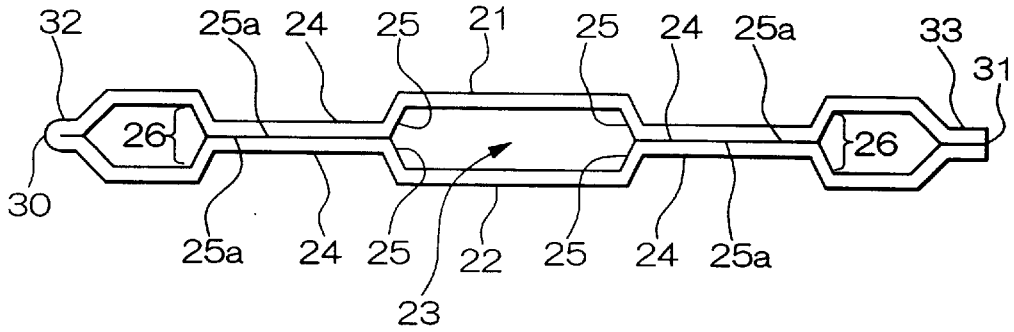
FIG. 3 is a sectional view of the tube taken along a line III—III in FIG. 2.

A top portion 25*a* of the swelling portion 25 has an elliptical shape in plan view being defined by a short length (or short diameter) and a long length (or a long diameter), which is placed along a length direction (i.e., "A" in FIG. 2) of the tube 11. As for two swelling portions 25 which are arranged opposite to each other, their top portions 25*a* are brought into contact with each other as shown in FIG. 3. That is, the two swelling portions 25 whose top portions 25*a* are brought into contact with each other are connected together to form a column 26 which is provided between the first and second walls 21, 22 and whose section has an elliptical shape. Incidentally, the sectional shape of the column 26 is not necessarily limited to the elliptical shape, so it can be formed like an elongated circular shape, for example. In addition, the column 26 is not necessarily made in a hollow shape, so it is possible to make the column 26 solid.

Figure 4:
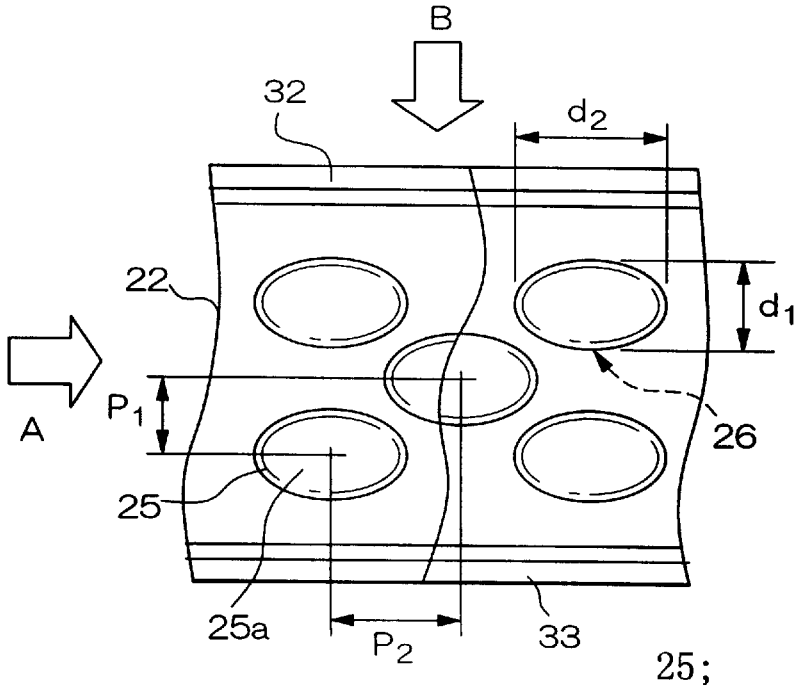
FIG. 4 is a sectional view of the tube take along a line IV—IV in FIG. 2.

The swelling portions 25 are arranged to adjoin with each other as shown in FIG. 4. Herein, adjacent swelling portions, which are arranged adjacent to each other obliquely with respect to the direction A, are arranged in a zigzag manner while being partially overlapped with each other in view of a direction perpendicular to the direction A. Therefore, the columns 26 are correspondingly arranged in a zigzag manner in conformity with the swelling portions 25.

In FIG. 2, an air inlet direction by which air is introduced to perform heat exchange coincides with a width direction B of the tube 11. The tube 11 has a front-end portion 30 and a back-end portion 31, which are arranged apart from each other in the air inlet direction. In addition, splitter plates 32, 33 are formed together with the front-end portion 30 and the back-end portion 31 respectively. Each of the splitter plates 32, 33 is formed in prescribed thickness which is relatively thin to act as a flow straightener for straightening an inlet air flow around the tube 11.

Figure 5:
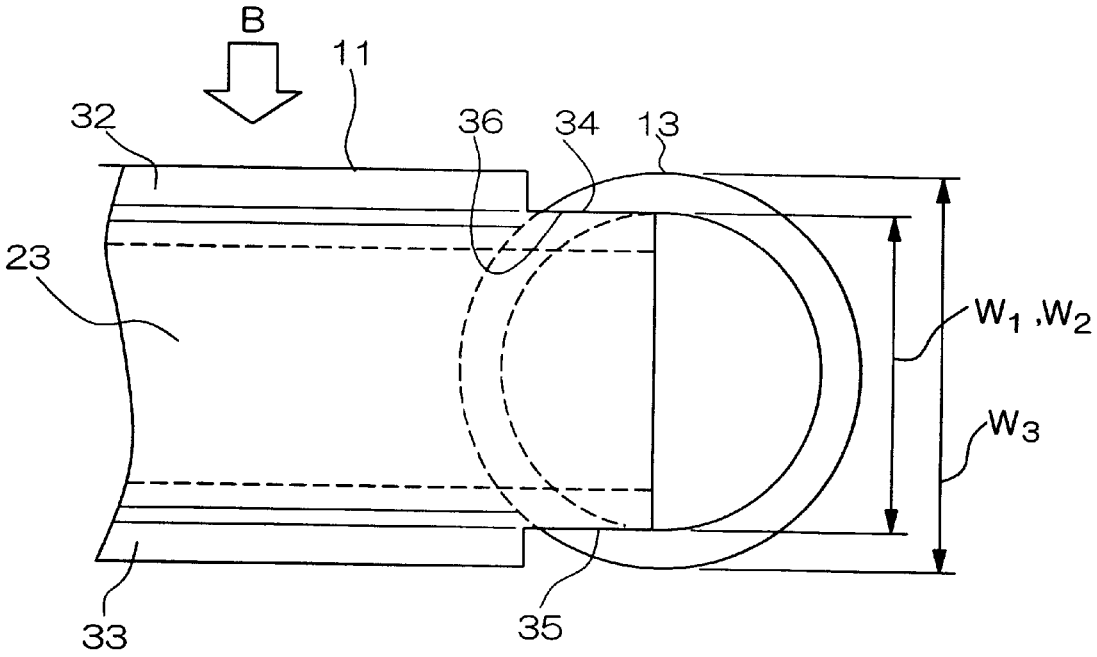
FIG. 5 is a plan view partly in section showing an end portion of the tube being inserted into a head pipe.

As shown in FIG. 1, both ends of the tube 11 are inserted into the head pipes 12, 13 respectively. Specifically, FIG. 5 shows that one end of the tube 11 is inserted into the head pipe 13. To actualize insertion, cut sections 34, 35 are formed by partly cutting out the splitter plates 32, 33 of the tube 11. That is, each end of the tube 11 has a prescribed end shape, by which it is inserted into the head pipe (12 or 13).

A number of tube insertion holes 36 are formed at selected positions on surfaces of the head pipes 12, 13. Each tube insertion hole 36 coincides with the end shape of the tube 11 to enable insertion of the tube 11 therein. To guide insertion of the tube 11, channels 37 (see FIG. 6D) are formed at both ends of the tube insertion hole 36 to allow cut ends of the splitter plates 32, 33 of the tube 11 being inserted therein.

The tube insertion hole 36 has an elongated shape whose width w1 substantially coincides with width w2 of the end portion of the tube 11 in which the cut sections 34, 35 are formed. In addition, an overall width w3 of the tube 11 including the splitter plates 32, 33 is made larger than the width w1 of the tube insertion hole 36. Thus, when the end portion of the tube 11 is inserted into the tube insertion hole 36, the cut ends of the splitter plates 32, 33 of the tube 11 collide with the head pipe (12 or 13) so that the tube 11 is prevented from being inserted into the tube insertion hole 36 further more.

Next, a description will be given with respect to a method for manufacturing the heat exchanger 10 with reference to FIGS. 6A to 6D.

Figure 6A:
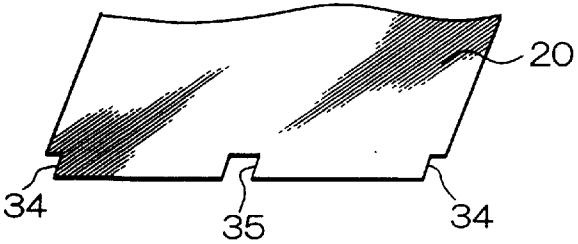
FIG. 6A is a perspective view showing a flat plate.

At first, a flat plate (or sheet metal) 20 shown in FIG. 6A is prepared for manufacture of the tube 11. Brazing material is clad on the surfaces of the flat plate 20, which are made as an interior surface and an exterior surface of the tube 11 being manufactured. In addition, prescribed sections are cut from selected end portions of the flat plate 20 in advance, wherein they are designated as the cut sections 34, 35.

Figure 6B:
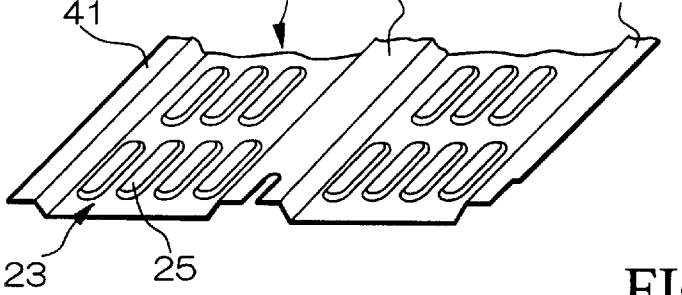
FIG. 6B is a perspective view showing the flat plate subjected to press working.
Figure 6C:
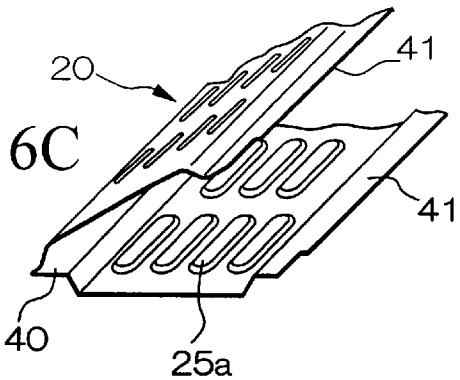
FIG. 6C is a perspective view showing the flat plate being bent to construct a tube.

Next, the flat plate 20 is subjected to press working or roll working to form swelling portions 25 in connection with a refrigerant passage 23 as shown in FIG. 6B. In addition, a bending overlap width 40 is formed in connection with a front-end portion 30, while brazing tabs 41 are formed in connection with a back-end portion 31. Then, the flat plate 20 is bent along with a center line of the bending overlap width 40, which is shown in FIG. 6C. As the flat plate 20 is being bent, the bending overlap width 40 is folded so that two parts thereof come in connection with each other, while the brazing portions 41 are approaching each other and are then brought in contact with each other. Further, top portions 25*a* of the swelling portions 25 are brought in contact with each other. Thus, it is possible to form the tube 11 having a flat shape.

Figure 6D:
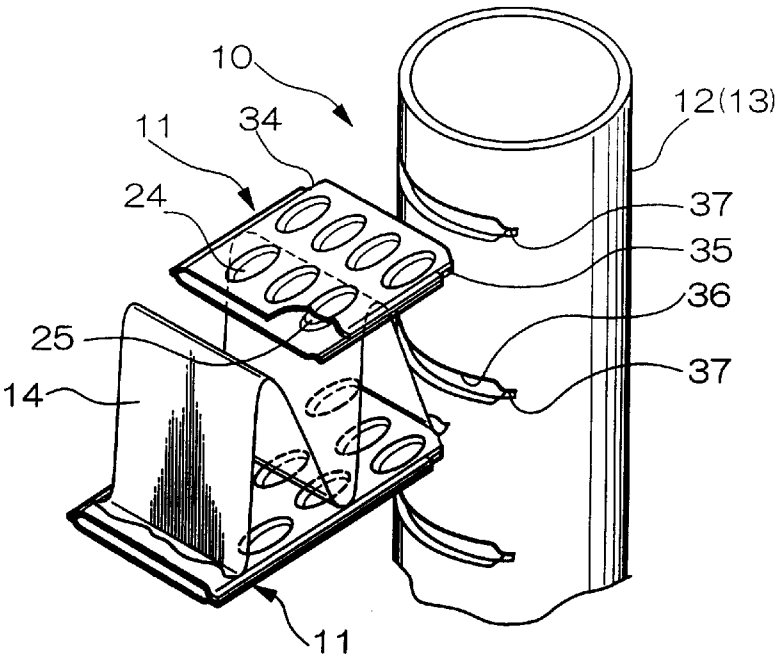
FIG. 6D is a perspective view showing that the tube and a corrugated fin are assembled together with a head pipe.

Next, there is prepared a head pipe 12 (or 13) having tube insertion holes 36 as shown in FIG. 6D. Herein, an end portion of the tube 11 is inserted into the tube insertion hole 36 of the head pipe 12 (or 13). In addition, a corrugated fin 14 is arranged between adjacent tubes 11 in elevation, so that a heat exchanger 20 is being assembled. Thereafter, the assembled heat exchanger 10 is put into a heating furnace (not shown), wherein it is heated for a certain time with a prescribed temperature. So, the brazing material clad on the surfaces of the flat plate 20 (i.e., tube 11) is melted, so that parts of the heat exchanger 10 are subjected to brazing. That is, brazing is performed on two parts of the bending overlap width 40, the brazing portions 41 and the top portions 25*a* of the swelling portions 25, all of which are respectively bonded together. In addition, brazing is performed between the end portion of the tube 11 and the tube insertion hole 36, which are bonded together. Further, brazing is performed to actualize bonding between the tube 11 and crest portions of the corrugated fin 14, which are brought in contact with each other when the corrugated fin 14 is arranged in connection with the tube 11.

In the heat exchanger 10 described above, each of columns 26 which are arranged inside of the refrigerant passage 23 has a prescribed sectional shape corresponding to an elliptical shape whose long length matches with the direction A. Thus, it is possible to improve a heat transfer rate while reducing flow resistance. Concretely speaking, a refrigerant flow may firstly collide with a front-end portion of the column 26 in which curvature becomes small along side surfaces. Thus, refrigerant flow is accelerated in flow velocity to progress from the front-end portion of the column 26 along its side surfaces. So, it is possible to improve a local heat transfer rate. Then, the refrigerant flow passes by the front-end portion to reach a back-end portion of the column 26. In that case, curvature becomes large along the side surfaces with respect to the back-end portion of the column 26. This hardly causes flow separation in which an eddy flow is separated from a main flow in the refrigerant flow. That is, it is possible to suppress shape resistance of the column 26 being small, so it is possible to reduce flow resistance.

Next, comparison is made between column bodies whose sectional shapes correspond to a circular shape and an elliptical shape respectively and which are arranged in flow fields. Herein, the column body having the elliptical shape in section is arranged in the flow field in such a way that a long length matches with a flow direction. In addition, a surface flow length along a side surface of the column body is given by a mathematical expression of $$\frac{s}{d2}$$

where "s" denotes a length from a stagnation point at a tip end of the column body along the side surface, while a surface local heat transfer rate is given by a mathematical expression of $$\frac{Nu}{Re^{1/2}}$$

where "Nu" denotes Nusselt number, and "Re" denotes Reynolds number.

Figure 7:
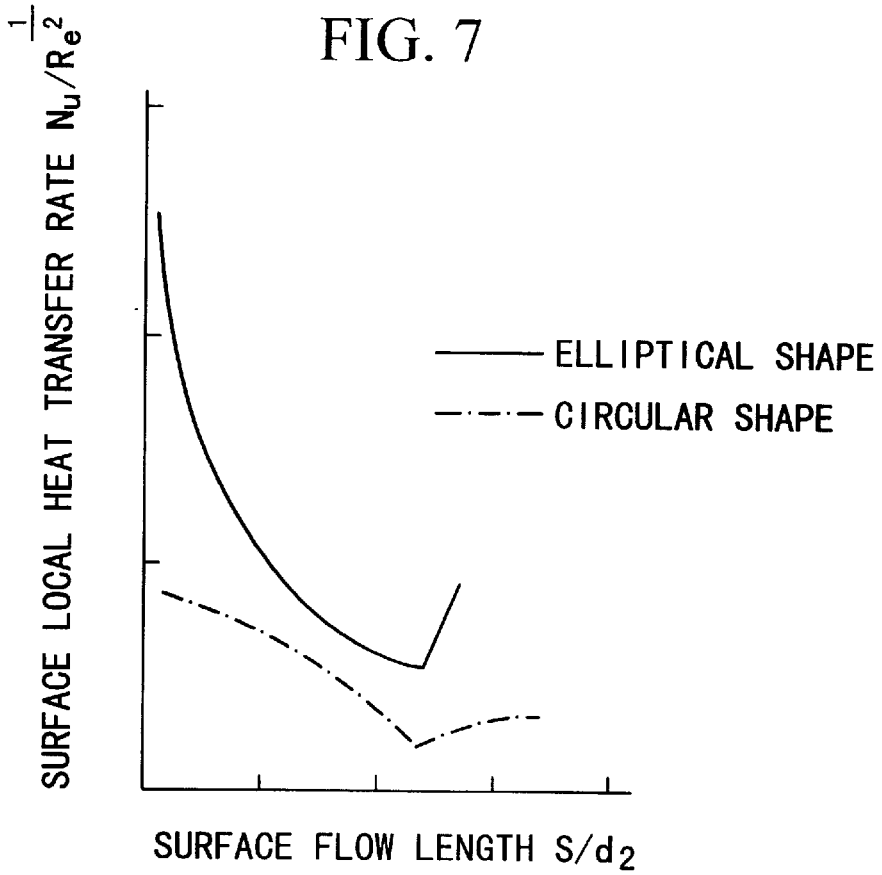
FIG. 7 is a graph showing comparison between column bodies having elliptical and circular shapes in section, which are placed in a flow field, with respect to a relationship between a surface flow length and a surface local heat transfer rate.
Figure 8:
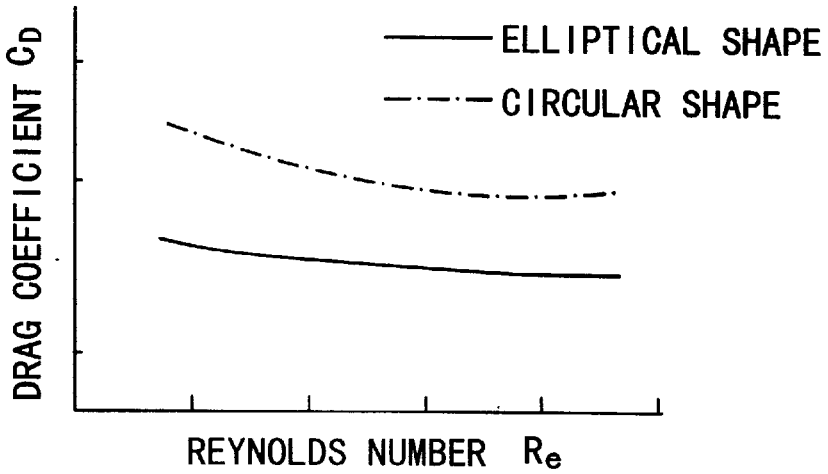
FIG. 8 is a graph showing comparison between the column bodies with respect to a relationship between Reynolds number and drag coefficient.

FIG. 7 shows a result of the comparison between the aforementioned column bodies with respect to a relationship between the surface flow length and surface local heat transfer rate. In addition, FIG. 8 shows a result of comparison between the column bodies with respect to a relationship between the Reynolds number Re and a drag coefficient CD representative of flow resistance. Incidentally, the column body having the elliptical section is referred to as an "elliptical" column body, while the column body having the circular section is referred to as a "circular" column body.

According to FIG. 7, the surface local heat transfer rate of the elliptical column body at its front-end portion (which is close to the stagnation point) has a remarkably high value as compared with the circular column body. In addition, the surface local heat transfer rate of the elliptical column body is reduced as a flow passes by the front-end portion to reach a back-end portion, but it is normally higher than the surface local heat transfer rate of the circular column body.

FIG. 8 shows that the drag coefficient of the elliptical column body is normally lower than the drag coefficient of the circular column body, regardless of variations of the Reynolds number Re. Roughly speaking, the drag coefficient of the elliptical column body is approximately a half of the drag coefficient of the circular column body.

It is preferable that the elliptical sectional shape of the column 26 meets a relationship of an inequality (1), as follows:

$$2.0 \le \frac{d2}{d1} \le 3.0 \tag{1}$$

where "d1" denotes a short length, and "d2" denotes a long length shown in FIG. 4.

In the inequality (1), as a value of d2/d1 becomes lower than 2.0, the sectional shape of the column 26 is gradually changed from the elliptical shape to the circular shape, so that the surface local heat transfer rate is reduced, while the drag coefficient is increased. In contrast, as the value of d2/d1 becomes higher than 3.0, curvature of the column body in proximity to its front-end portion becomes too small to cause the foregoing flow separation, so that the surface local heat transfer rate is being reduced.

In addition, the heat exchanger 10 is designed such that the columns 26 are arranged inside of the refrigerant passage 23 in a zigzag manner. Herein, refrigerant flow inside of the refrigerant passage 23 by branches like net patterns, wherein the columns 26 are located at intersections of branches of a refrigerant flow. That is, the refrigerant flow effectively collides with front-end portions of the columns 26. Thus, it is possible to improve a heat transfer rate with respect to the heat exchanger 10.

Figure 9:
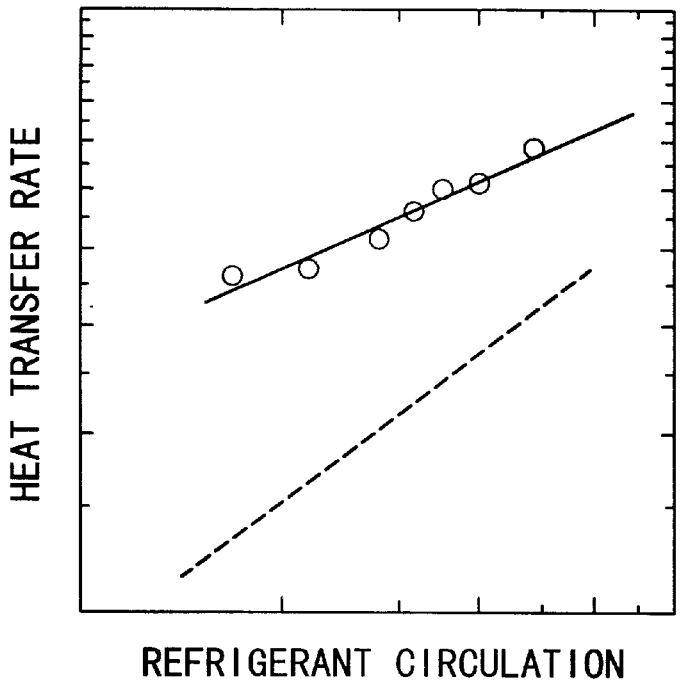
FIG. 9 is a graph showing comparison between a tube having elliptical columns and an extrusion tube with respect to a relationship between refrigerant circulation and heat transfer rate.
Figure 10:
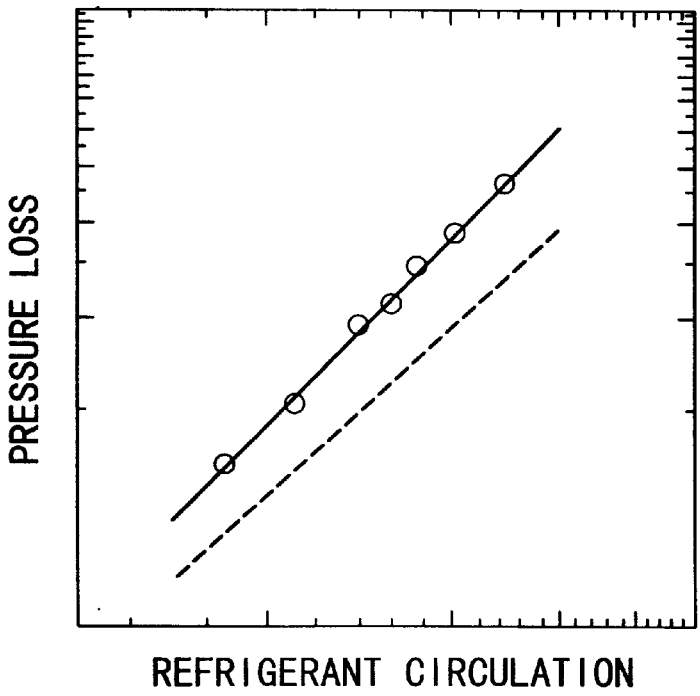
FIG. 10 is a graph showing comparison between the tube having the elliptical columns and extrusion tube with respect to a relationship between refrigerant circulation and pressure loss.
Figure 11A:
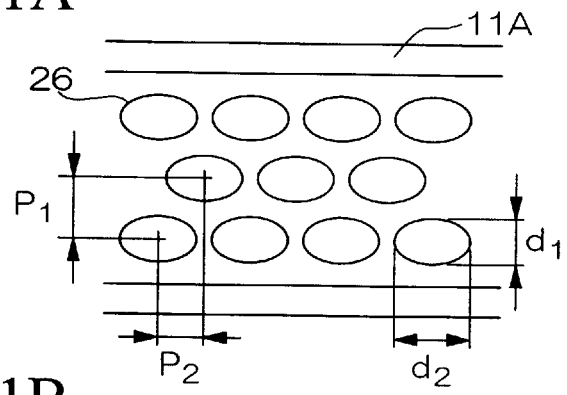
FIG. 11A is a sectional view of a tube 11A containing columns therein.
Figure 11B:
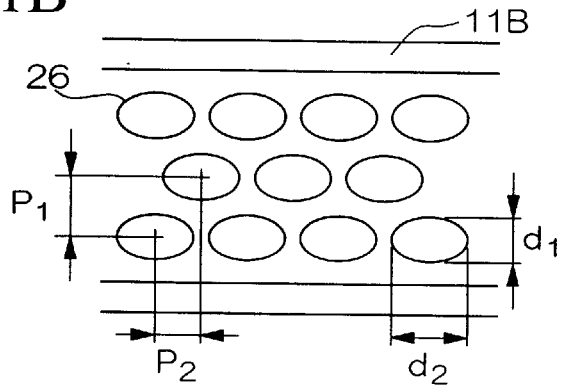
FIG. 11B is a sectional view of a tube 11B containing columns therein.
Figure 11C:
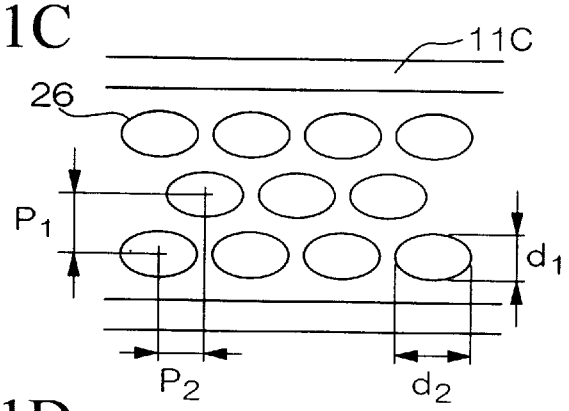
FIG. 11C is a sectional view of a tube 11C containing columns therein.
Figure 11D:
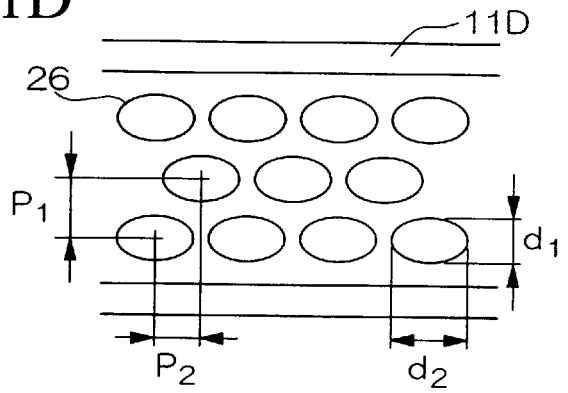
FIG. 11D is a sectional view of a tube 11D containing columns therein.

Next, comparison is made between the tube 11 (which corresponds to a tube 11A in shape, see FIG. 11A) in which a number of columns each having a sectional shape meeting the aforementioned inequality (1) are formed and the conventional extrusion tube which is made by extrusion molding with respect to heat exchange performance. Herein, two kinds of graphs are provided to show comparison results between them. Specifically, FIG. 9 shows a relationship between refrigerant circulation and heat transfer rate, while FIG. 10 shows a relationship between refrigerant circulation and pressure loss. Those graphs show that both of the tube 11 having the columns and the extrusion tube are similarly increased in pressure loss in response to increase of the refrigerant circulation. However, it is clearly shown that as compared with the extrusion tube, the tube 11 is capable of remarkably increasing the heat transfer rate in response to the increase of the refrigerant circulation.

In FIG. 4, a reference symbol "p1" designates a center distance (or pitch) between two columns which are arranged obliquely adjacent to each other in a direction B (corresponding to a width direction of the tube). In addition, a reference symbol "p2" designates a center distance between the two columns which are arranged obliquely adjacent to each other in a direction A. According to our experimental results, the center distances p1, p2 should be respectively related to a short length d1 and a long length d2 of the column by prescribed relationships, which are expressed by inequalities (2), (3), as follows:

$$1.5 \le \frac{p1}{d1} \le 3.0 \tag{2}$$

$$0.5 \le \frac{p2}{d2} \le 1.5 \tag{3}$$

That is, it is preferable that the columns are arranged in a zigzag manner to meet the aforementioned relationships.

The inequality (2) is determined by the following reasons: If a value of p1/d1 becomes lower than 1.5, an interval of distance between obliquely adjacent columns in the direction B is narrowed to increase flow resistance in the refrigerant passage 23. If the value of p1/d1 becomes larger than 3.0, the interval of distance between the obliquely adjacent columns are broadened to decrease the flow resistance in the refrigerant passage 23, while flow speed of the refrigerant flowing between the columns is reduced to decrease the heat transfer rate.

The inequality (3) is determined by the following reasons: If a value of p2/d2 becomes lower than 0.5, an interval of distance between obliquely adjacent columns in the direction A is narrowed so that branch flows of refrigerant around the columns interfere with each other. This decreases the flow resistance and correspondingly reduces the heat transfer rate. If the value of p2/d2 becomes larger than 1.5, the interval of distance between the obliquely adjacent columns in the direction A is broadened so that branch flows of refrigerant at back sides of the columns are reduced. This reduces the heat transfer rate as well.

Figure 12:
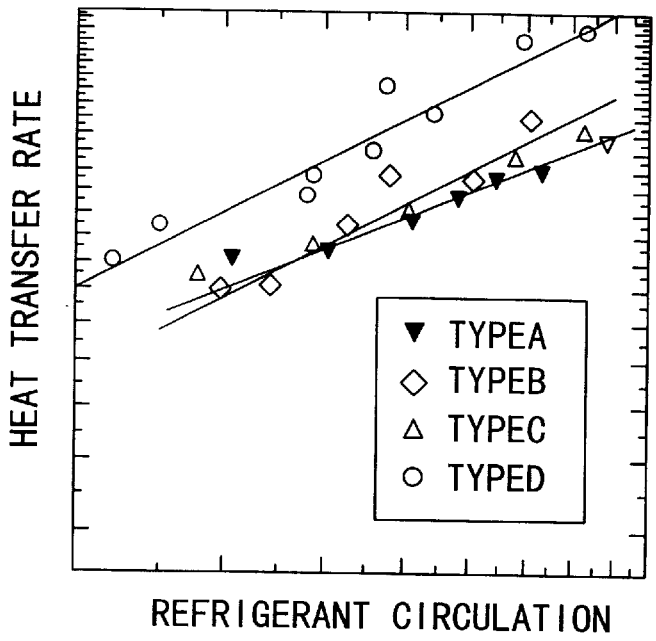
FIG. 12 is a graph showing comparison between the tubes 11A, 11B, 11C and 11D with respect to a relationship between refrigerant circulation and heat transfer rate.
Figure 13:
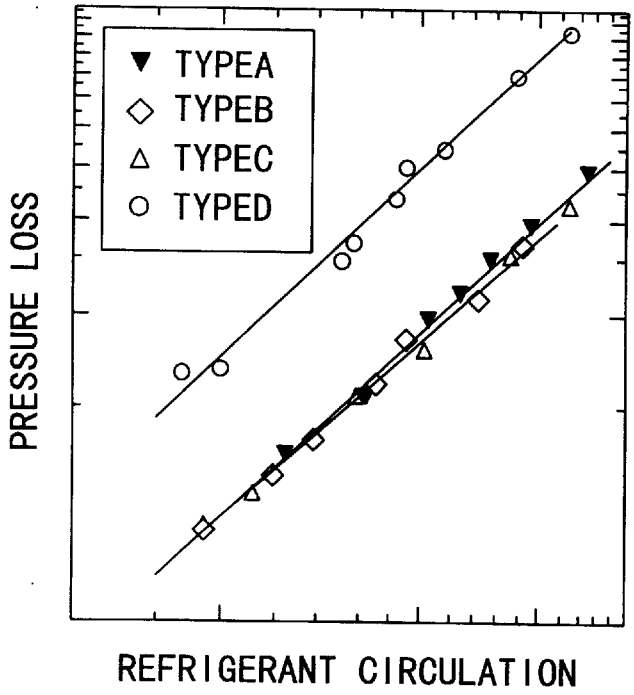
FIG. 13 is a graph showing comparison between the tubes 11A, 11B, 11C and 11D with respect to a relationship between refrigerant circulation and pressure loss.

Next, comparison is made with respect to four types of tubes 11A, 11B, 11C and 11D, which are different from each other in arrangement of columns as shown in FIGS. 11A, 11B, 11C and 11D. Two graphs are provided to show comparison results between them. Specifically, FIG. 12 shows relationships between refrigerant circulation and heat transfer rate, and FIG. 13 shows relationships between refrigerant circulation and pressure loss. Among the four types of the tubes, all of the columns have a same sectional shape, in which d1=3.0 and d2=6.1.

FIG. 12 shows that substantially same values are measured with respect to the heat transfer rate against the refrigerant circulation in the tube A (where p1/d1≈1.5, p2/d2≈0.6), tube B (where p1/d1≈1.5, p2/d2≈1.15) and tube C (where p1/d1≈2.0, p2/d2≈1.15). As compared with those tubes A, B and C, the tube D (where p1/d1≈27, p2/d2≈1.15) shows normally higher values with respect to the heat transfer rate against the refrigerant circulation.

FIG. 13 shows that substantially same values are measured with respect to the pressure loss against the refrigerant circulation in the tubes A, B and C. As compared with those tubes A, B and C, the tube D shows slightly higher values with respect to the pressure loss against the refrigerant circulation, wherein small differences of the heat transfer rate emerge between the tube D and the other tubes (A, B, C).

In the heat exchanger 10 (see FIG. 4), all the columns 26 are arranged to be separated from each other, wherein obliquely adjacent columns are arranged being partly overlapped with each other in the direction A. Such arrangement of the columns provides improvements in heat transfer rate and pressure-proof strength with respect to the tube 11 as a whole. Concretely speaking, the surface local heat transfer rate measured along the side surface of the column is made highest at the front-end portion and becomes lower in a direction toward the back-end portion. Consideration is made with respect to two obliquely adjacent columns which are obliquely arranged in the direction A, namely, an upstream column and a downstream column which are arranged at different locations along the refrigerant flow. Herein, the upstream column and downstream column are arranged being partly overlapped with each other in the direction A. That is, a front-end portion of the downstream column is located in an upstream side rather than a back-end portion of the upstream column. In that case, the front-end portion of the downstream column compensates for reduction of the surface local heat transfer rate at the back-end portion of the upstream column. Thus, it is possible to improve the overall heat transfer rate of the tube 11 on the average.

In the obliquely adjacent columns described above, the front-end portion of the downstream column is located in the upstream side rather than the back-end portion of the upstream column. In other words, the columns partly overlap with each other in arrangement in the direction A. So, any section of the tube 11 taken along a line perpendicular to the direction A normally contain the column(s). As shown in FIG. 3, each column is made by bonding the top portions (25*a*) of the swelling portions (25) respectively formed on the first and second walls 21, 22 by brazing. In other words, each column acts as a joint formed between the first and second walls 21, 22. Because the columns are arranged regularly in the direction A, it is possible to secure broad joint portions between the top portions (25*a*) of the swelling portions (25). For this reason, any section of the tube 11 taken in the direction A contains adhesion between the swelling portions 25 of the first and second walls 21, 22. Thus, it is possible to increase joint strength between the first and second walls 21, 22 of the tube 11, and it is possible to secure a sufficiently high pressure-proof strength with respect to the tube 11 even if the thickness of the flat plate 20 is thin.

Second Embodiment

Next, a heat exchanger having a tube 11 which is designed in accordance with a second embodiment of the invention will be described with reference to FIG. 13, wherein parts equivalent to those used in the first embodiment will be designated by the same reference numerals, hence, the description thereof will be omitted.

Figure 14:
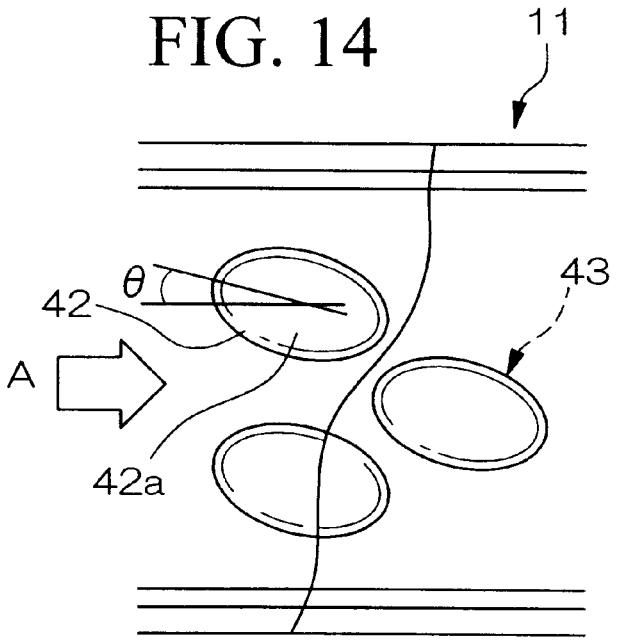
FIG. 14 is a sectional view of a tube containing columns used in a heat exchanger in accordance with a second embodiment of the invention.

As shown in FIG. 14, swelling portions 42 whose sectional shapes correspond to ellipses each having a long length and a short length are formed and arranged in a slanted manner with respect to a direction A on interior surfaces of the tube 11. That is, each of the swelling portions 42 is arranged in such a manner that the long length thereof is arranged with inclination to a horizontal line corresponding to the direction A by a prescribed angle θ. As similar to the foregoing first embodiment, each pair of the swelling portions 42 are arranged to conform with each other in elevation such that their top portions 42 are brought into contact with each other. Thus, a column 43 is made by jointing together the pair of the swelling portions 42 inside of the tube 11. In addition, the swelling portions 42 are arranged in a zigzag manner with respect to the direction A. That is, obliquely adjacent swelling portions which are arranged obliquely adjacent to each other in the direction A are arranged independently from each other but are partly overlapped with each other along the direction A. Thus, columns 43 are arranged correspondingly in conformity with the swelling portions 42.

Like the foregoing first embodiment, the heat exchanger of the second embodiment is designed such that obliquely adjacent columns 43 are arranged being partly overlapped with each other along the direction A in the tube 11. So, it is possible to provide improvements in heat transfer rate and pressure-proof strength of the tube 11. In addition, the second embodiment is characterized by that each of the swelling portions 42 constructing the columns 43 is arranged in a slanted manner in which its long length is arranged with inclination to the direction A by the angle θ. This technical feature of the second embodiment will be described in detail in consideration of two columns (43), namely, an upstream column and a downstream column which are arranged adjacent to each other but are arranged at different locations within the refrigerant flow. Herein, a front-end portion of the downstream column is located slightly different from a back-end portion of the upstream column by a prescribed offset in a direction B (which is perpendicular to the direction A, not shown in FIG. 14). For this reason, the front-end portion of the downstream column does not act as a "shadow zone" for the refrigerant flow. This increases an amount of refrigerant that collide with each of front-end portions of the columns 43. Thus, it is possible to improve the heat transfer rate with respect to the tube 11 as a whole.

Incidentally, it is preferable to set the inclination angle θ within a range of ±7°. Such a range is determined by the following reasons:

If the inclination angle is gradually increased from 0° the heat transfer rate is correspondingly improved so that the second embodiment is able to demonstrate remarkable effects in heat-exchange property. However, when the inclination angle becomes larger or lower than the range of ±7°, flow separation is easily caused to occur in the refrigerant flow, so that the heat transfer rate is reduced.

Third Embodiment

Figure 15:
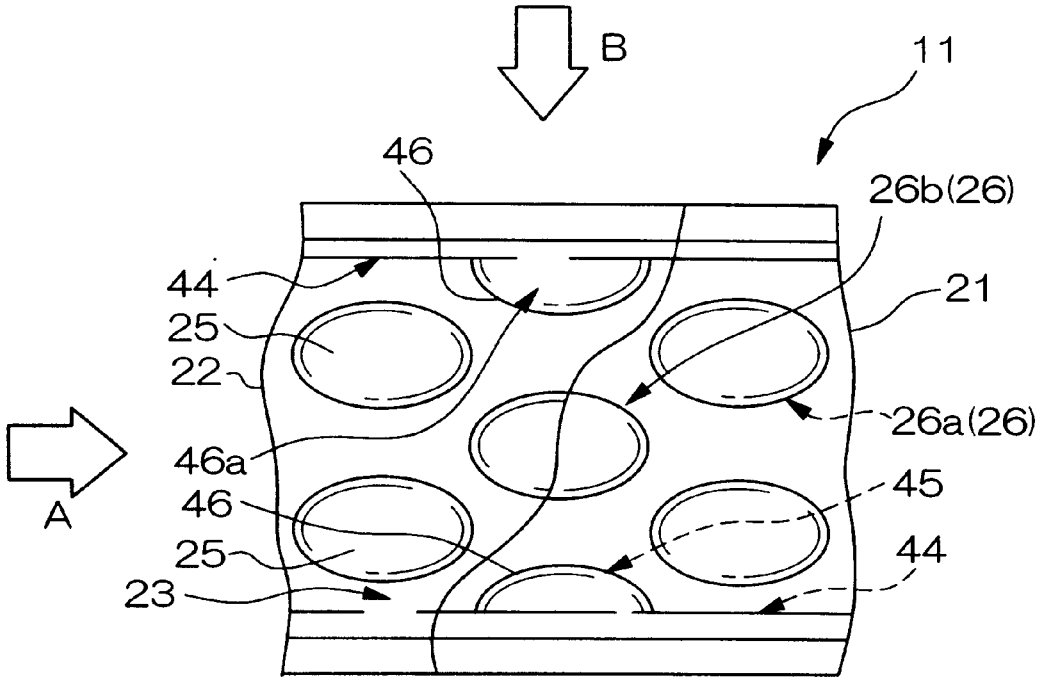
FIG. 15 is a sectional view of a tube containing columns and semi-columns used in a heat exchanger in accordance with a third embodiment of the invention.

Next, a heat exchanger having a tube 11 which is designed in accordance with a third embodiment of the invention will be described with reference to FIGS. 15 and 16, wherein parts equivalent to those used by the first embodiment are designated by the same reference numerals, hence, the description thereof will be omitted.

Like the foregoing first embodiment, the third embodiment is basically designed such that the tube 11 is constructed by first and second walls 21, 22 between which columns 26 are formed by swelling portions 25 and are arranged obliquely adjacent to each other. In FIG. 15, the third embodiment is characterized by that side walls 44 are formed and arranged integrally with side-end portions of the first and second walls 21, 22. Therefore, a refrigerant passage 23 is formed and encompassed by those walls 21, 22, 44. In addition, semi-columns 46 each having a prescribed shape corresponding to a semi-shape of the aforementioned column 26 whose sectional shape corresponds to an ellipse are arranged on the side walls 44. Each of the semi-columns 46 is formed by a pair of semi-swelling portions 45 whose top portions are brought into contact with each other. Herein, the semi-swelling portions 45 are formed by applying external pressures to exterior surfaces of the first and second walls 21, 22 to partially cave in at selected positions.

Each of the semi-columns 46 whose sectional shapes correspond to semi-ellipses is arranged in connection with the columns 26 whose sectional shapes correspond to ellipses and which are arranged in a zigzag manner. That is, one semi-column 46 is arranged on the side wall 44 at a prescribed location, which approximately corresponds to a center position between two columns (each designated by a reference numeral "26*a*") being arranged adjacent to each other along a direction A within the columns 26. In addition, the semi-column 46 is also arranged adjacent to a column 26*b*, which is arranged obliquely adjacent to the column 26*a*, along a direction B.

According to the heat exchanger of the third embodiment having the tube 11 in which the semi-columns 46 each having the semi-shape of the column 26 are arranged on the side walls 44, it is possible to provide improvements in heat transfer rate and pressure-proof strength of the tube 11. Concretely speaking, the columns 26 whose sectional shapes correspond to ellipses are arranged in a zigzag manner along the direction A in the tube 11, wherein one or two columns 26 are arranged in each section taken along the direction B. In other words, there are two kinds of sections each taken along the direction B, namely, a first section in which two columns 26*a* are arranged and a second section in which one column 26*b* is arranged. Those sections are arranged alternately along the direction A in the tube 11. As compared with the first section having the two columns 26*a*, the second section having the column 26*b* is reduced in joint strength because of a small total joint area formed between the first and second walls 21, 22 which are jointed together by the column 26*b*. In other words, the second section having the column 26*b* is reduced in pressure-proof strength as compared with the first section having the two columns 26*a*. To compensate reduction of the pressure-proof strength, the semi-columns 46 each having a semi-shape of the column 26 are arranged in connection with the second section having the column 26*b* so as to increase a total joint area between the first and second walls 21, 22 which are jointed together by the column 26*b* and two semi-columns 46 with respect to the second section. Therefore, it is possible to increase the joint strength with respect to the second section. In other words, it is possible to increase the pressure-proof strength of the second section being substantially equivalent to the pressure-proof strength of the first section having the two columns 26*a*.

By provision of the semi-columns 46, turbulence is caused to occur in refrigerant flows along the side walls 44, so it is possible to improve an overall heat transfer rate of the tube 11 because of increasing turbulence effects.

Figure 16:
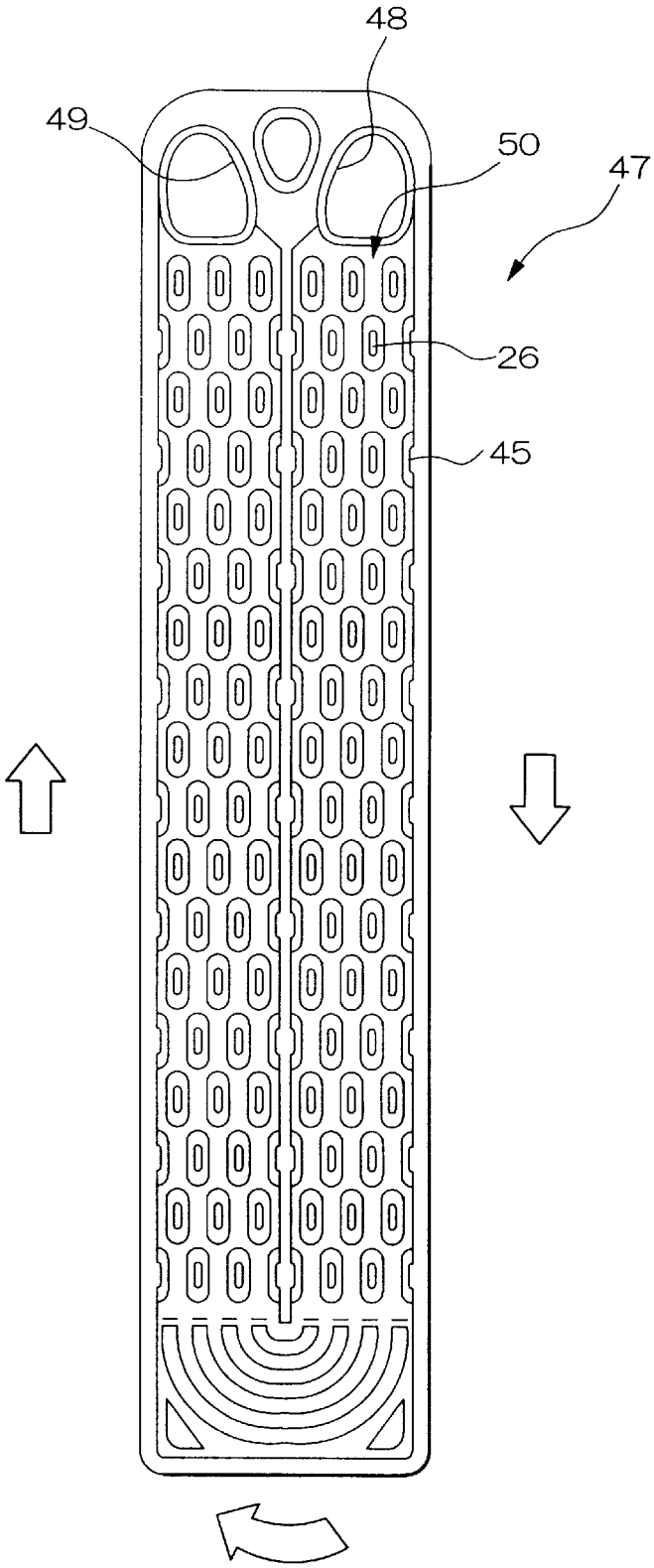
FIG. 16 is a plan view showing a modified example of the tube used for the heat exchanger of the third embodiment.

FIG. 16 shows a modified example of the heat exchanger of the third embodiment, which is designed as a laminated heat exchanger used for an evaporator. Herein, the heat exchange of FIG. 16 has a refrigerant passage unit 47 equipped with a U-shaped refrigerant passage 50 having a refrigerant inlet 48 and a refrigerant outlet 49 at upper ends. That is, refrigerant is introduced into the refrigerant inlet 48 to flow inside of the U-shaped refrigerant passage 50, wherein it firstly flows down to a lower end and then flows upwardly toward the refrigerant outlet 49. The U-shaped refrigerant passage 50 is not formed in a straight shape like the foregoing refrigerant passage 23 but is basically designed to have columns as similar to the refrigerant passage 23 inside of the tube 11 shown in FIG. 15. That is, semi-columns are arranged along side walls of the refrigerant passage 50. Thus, it is possible to improve pressure-proof strength and heat transfer rate with respect to the refrigerant passage unit 47.

Fourth Embodiment

Figure 17:
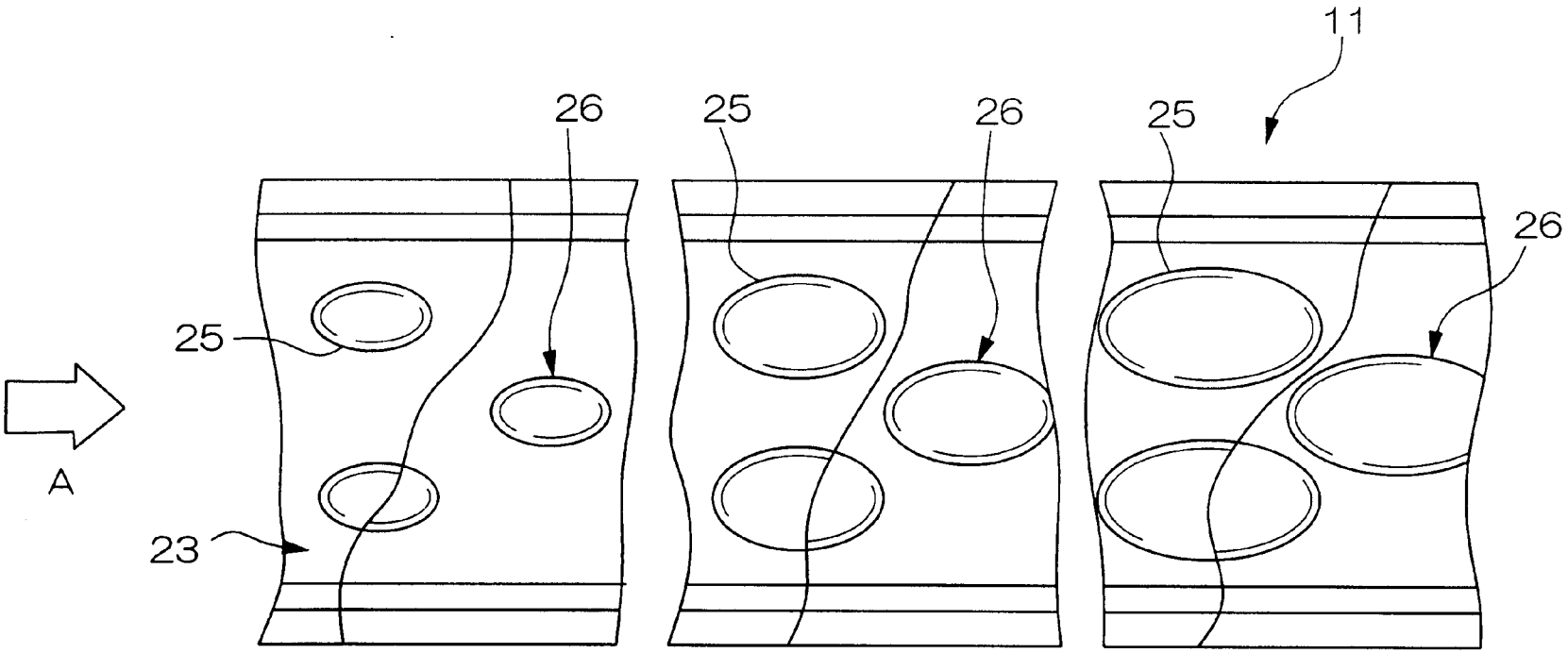
FIG. 17 is a sectional view of a tube containing columns having different shapes and sizes used in a heat exchanger in accordance with a fourth embodiment of the invention.

Next, a heat exchanger having a tube 11 which is designed in accordance with a fourth embodiment of the invention will be described with reference to FIG. 17, wherein parts equivalent to those used by the first embodiment are designated by the same reference numerals, hence, the description thereof will be omitted.

The heat exchanger of the fourth embodiment is designed as a condenser that condenses refrigerant by radiating heat to the external air. The present heat exchanger uses the tube 11 shown in FIG. 17, which is characterized by that each of swelling portions 25 is gradually enlarged in size along a direction A while maintaining figure similarity in sectional shape. Along with the direction A, relatively small swelling portions are formed and arranged in an upstream side, while relatively large swelling portions are formed and arranged in a downstream side. Hence, densities (or occupied areas) of the swelling portions in the upsteam side are relatively small, while the swelling portions are closely and tightly arranged with each other in the downstream side. Therefore, columns 26 are correspondingly formed and arranged in coformity with the swelling portions 25. As a result, sectional areas of a refrigerant passage 23 taken along lines perpendicular to the direction A become small in the direction A from the upstream side to the downstream side of the tube 11.

In the case of the heat exchanger that is designed as the condenser, dryness is reduced in response to progress of refrigerant that flow from the upstream side to the downstream side, in other words, a liquid phase is increased as compared with a gas phase in response to the progress of the refrigerant. For this reason, pressures which are imparted to interior wall surfaces of the tube 11 by refrigerant are gradually reduced along the direction A. To compensate reduction of the pressures, the tube 11 used by the heat exchanger of the fourth embodiment is designed such that sectional areas of the refrigerant passage 23 are gradually reduced in response to the reduction of the pressures. So, it is possible to provide substantially constant pressures being imparted to the interior wall surfaces of the tube 11. Thus, it is possible to secure substantially a constant heat transfer rate having a relatively high value within an overall area of the tube 11 in its length direction. In addition, it is possible to reduce pressure loss being constantly low within the overall area of the tube 11 in its length direction.

As described above, the tube 11 of the fourth embodiment is characterized by that the columns 26 are made being gradually enlarged in sizes while maintaining a certain figure similarity in the direction A directing from the upstream side to the downstream side. So, the sectional areas of the refrigerant passage 23 taken along lines perpendicular to the direction A are made being gradually reduced in the direction A from the upstream side to the downstream side. The fourth embodiment can be modified such that the columns 26 are changed in size as well as shape without maintaining figure similarity. Or, it can be modified such that the columns 26 are not changed in sizes but are changed in arrangement (or density) in the direction A.

Fifth Embodiment

Next, a heat exchanger 10 which is designed in accordance with a fifth embodiment of the invention will be described with reference to FIG. 18.

The heat exchanger of the fifth embodiment is designed as an evaporator that absorbs heat from the external air to gasify refrigerant. The present heat exchanger is constructed by laminating refrigerant passage units 53, each of which is formed by overlapping together flat plates 51, 52 each roughly having a rectangular shape as shown in FIG. 18. Herein, the flat plates 51, 52 are assembled together by jointing their peripheral portions and center portions together. Thus, a U-shaped refrigerant passage 56 which is shaped like a flat tube is formed in the refrigerant passage unit 53 having a refrigerant inlet 54 and a refrigerant outlet 55 at upper ends. Thus, refrigerant is introduced into the refrigerant inlet 54 to flow inside of the U-shaped refrigerant passage 56, wherein it flows down to a lower end and then flows upwardly toward to the refrigerant outlet 55.

Figure 18:
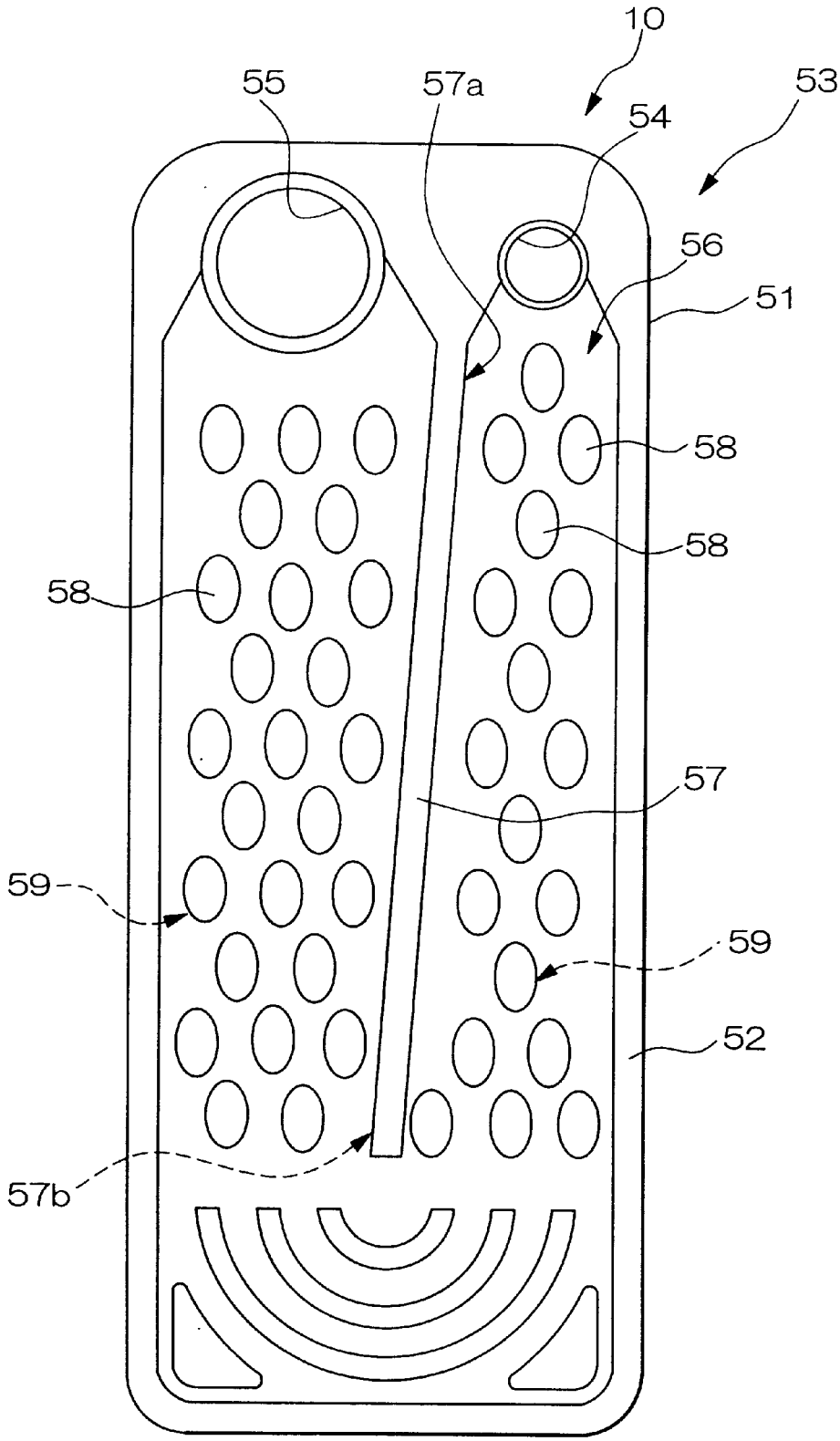
FIG. 18 is a plan view of a refrigerant passage unit, which is an essential part of a heat exchanger of a fifth embodiment of the invention.
Figure 19:
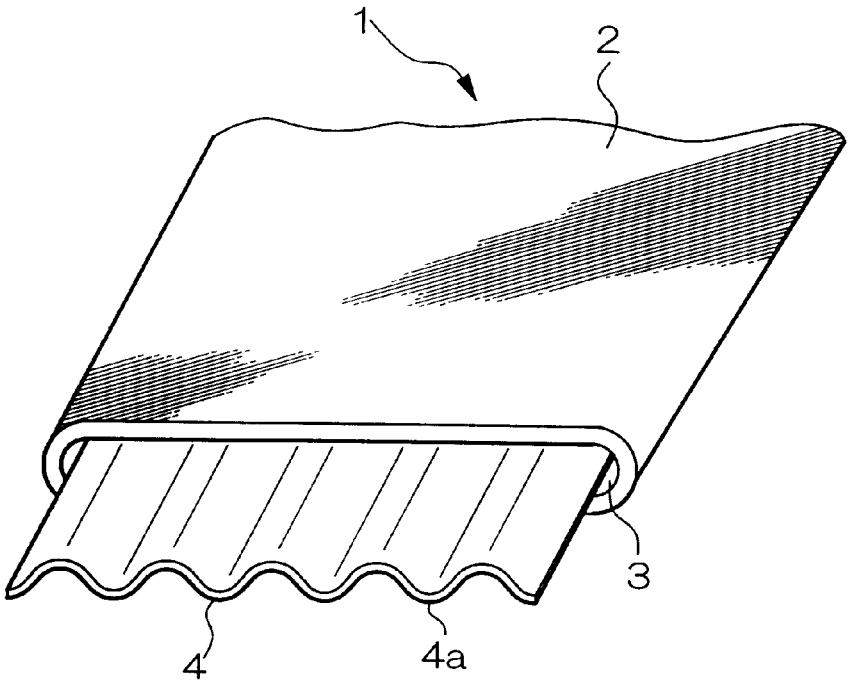
FIG. 19 is a perspective view showing an example of a seam welded tube which is conventionally used for a heat exchanger.
Figure 20:
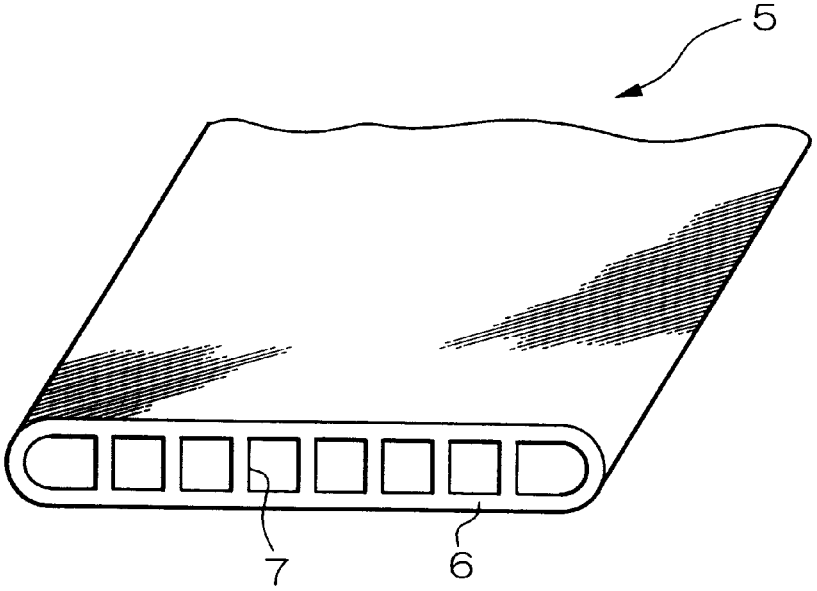
FIG. 20 is a perspective view showing an example of an extrusion tube which is conventionally used for a heat exchanger.

When the center portions of the flat plates 51, 52 are jointed together, a partition portion 57 is formed to partition the refrigerant passage 56 into two sections (i.e., a right section and a left section in FIG. 18). Herein, the partition portion 57 is formed in a slanted manner. That is, a lower end 57*b* of the partition portion 57 is arranged substantially at a center with an equal distance being measured from both ends of the flat plates 51, 52, while an upper end 57*a* of the partition portion 57 is arranged close to the refrigerant inlet 54 rather than the refrigerant outlet 55. As a result, sectional areas of the refrigerant passage 56 taken along lines perpendicular to a flow direction of refrigerant are made small in upstream areas but are made large in downstream areas. That is, the sectional shapes of the refrigerant passage 56 are gradually increased along refrigerant flow from an upstream side to a downstream side.

In addition, external wall surfaces of the flat plates 51, 52 which are arranged opposite to each other are pressed to cave in at selected positions to form a number of swelling portions 58. Therefore, plural columns 59 are formed by jointing together top portions of the corresponding swelling portions 58, which are formed on interior wall surfaces of the flat plates 51, 52 and are arranged in connection with each other.

In the refrigerant passage 56, the columns 59 are uniformly arranged to maintain constant distances in a refrigerant flow direction and its perpendicular direction. That is, a constant distance is maintained between adjacent columns 59 in the refrigerant flow direction. In addition, a constant distance is also maintained between adjacent columns 59 in a direction perpendicular to the refrigerant flow direction. Due to such uniform arrangement of the columns 59 and a slanted arrangement of the partition portion 57, it is possible to make sectional areas of the refrigerant passage 56, taken along lines perpendicular to the refrigerant flow direction, being larger in a direction from the upstream side to the downstream side.

In the case of the heat exchanger which is designed as the evaporator, dryness is increased in response to progress of refrigerant that flow from the upstream side to the downstream side, in other words, gas phase is increased as compared with liquid phase in response to the progress of the refrigerant. For this reason, pressures imparted to interior wall surfaces of the refrigerant passage 56 are gradually increased in the refrigerant passage unit 53. To cope with increases of the pressures, the heat exchanger of the fifth embodiment using the refrigerant passage unit 53 is designed such that the sectional areas of the refrigerant passage 56 are made gradually larger in response to the increases of the pressures. Thus, it is possible to secure substantially a constant heat transfer rate having a relatively high value within an overall area of the refrigerant passage 56 in its refrigerant flow direction. In addition, it is possible to reduce pressure loss being constantly low within the overall area of the refrigerant passage 56 in its refrigerant flow direction.

In the aforementioned refrigerant passage unit 53, the columns 59 are uniformly arranged in the refrigerant passage 56 such that a constant distance is maintained between the adjacent columns, so that the sectional areas of the refrigerant passage 56 are gradually increased in the refrigerant flow direction from the upstream side to the downstream side. The fifth embodiment can be modified such that the columns 59 are subjected to uniform arrangement but are gradually enlarged in size along the refrigerant flow direction toward the downstream side. Or, it can be modified such that the columns 59 are not changed in size but are gradually increased in number along the refrigerant flow direction toward the downstream side, in other words, densities of the columns 59 are gradually increased along the refrigerant flow direction toward the downstream side.

As described heretofore, this invention has a variety of technical features and effects, which are summarized as follows:

(1) A heat exchanger of this invention basically uses tubes, each of which is designed such that a number of columns are arranged inside of a refrigerant passage and are made by jointing together top portions of swelling portions of first and second walls, which are arranged opposite to each other. According to one aspect of the invention, adjacent columns are arranged at different locations in a refrigerant flow in such a way that a front-end portion of a downstream column is arranged in an upstream side as compared with a back-end portion of an upstream column. Herein, the front-end portion of the downstream column compensates for reduction of a surface local heat transfer rate at the back-end portion of the upstream column. Thus, it is possible to improve an overall heat transfer rate of the tube on the average.

(2) Because the adjacent columns are arranged such that the front-end portion of the downstream column is arranged in the upstream side as compared with the back-end portion of the upstream column, the columns normally exist being partly overlapped with each other in any sections of the tube being taken along lines perpendicular to its length direction, in other words, the swelling portions of the first and second walls are bonded together at any sections of the tube. Thus, it is possible to improve a joint strength for jointing the first and second walls together as well as a pressure-proof strength of the tube as a whole.

(3) According to a second aspect of the invention, semi-columns are arranged on side walls of the tube constructed by the first and second walls and are made by jointing together top portions of semi-swelling portions. This increases joint areas between the first and second walls, so it is possible to increase an overall joint strength between the first and second walls. By provision of the semi-columns on the side walls of the tube, turbulence is caused to occur in refrigerant flows along the side walls. This increases turbulent effects, so it is possible to improve an overall heat transfer rate with respect to the tube.

(4) According to a third aspect of the invention, the columns each having an elliptical sectional shape having a long length and a short length are formed and arranged in a slanted manner such that the long length is slanted with a certain angle of inclination to the length direction of the tube. This provides an offset in a width direction of the tube between the front-end portion of the downstream column and the back-end portion of the upstream column. In other words, the front-end portion of the downstream column does not act as a shadow zone in the refrigerant flow. That is, it is possible to increase amounts of refrigerant colliding with front-end portions of the columns, so it is possible to improve an overall heat transfer rate with respect to the tube.

(5) In order to use the heat exchanger as the condenser, the columns arranged inside of the tube are gradually increased in number or density along the refrigerant flow direction, so that sectional areas of the refrigerant passage taken along lines perpendicular to a length direction of the tube are gradually reduced in response to pressures, which are imparted to interior wall surfaces of the tube and which are gradually reduced in a refrigerant flow direction from an upstream side to a downstream side. Therefore, it is possible to stabilize the pressures being substantially constant. Thus, it is possible to secure substantially a constant heat transfer rate having a relatively high value within an overall area of the tube in its length direction. In addition, it is possible to reduce pressure loss being constantly low within the overall area of the tube in its length direction.

(6) In order to use the heat exchanger as the evaporator, the columns arranged inside of the tube are gradually decreased in number or density in the refrigerant flow direction, so that the sectional areas of the refrigerant passage are gradually enlarged in response to pressures, which are imparted to the interior wall surfaces of the tube and which are gradually increased in the refrigerant flow direction from the upstream side to the downstream side. Therefore, it is possible to stabilize the pressures being substantially constant. Thus, it is possible to secure substantially a constant heat transfer rate having a relatively high value within an overall area of the tube in its length direction. In addition, it is possible to reduce pressure loss being constantly low within the overall area of the tube in its length direction.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A heat exchanger comprising:

a flat tube constructed by a first wall and a second wall which are arranged opposite and apart in parallel with each other and are assembled together to form a refrigerant passage; and a plurality of columns each having a prescribed sectional shape corresponding to an elliptical shape or an elongated circular shape each defined by a short length d1 and a long length d2, wherein the plurality of columns are arranged between the first and second walls and are arranged to align long lengths thereof along a length direction of the flat tube such that obliquely adjacent columns, which are arranged adjacent to each other obliquely with respect to the length direction of the flat tube, are arranged at different locations but are partly overlapped with each other with long lengths thereof in view of a width direction perpendicular to the length direction of the flat tube, wherein each of the plurality of columns has the prescribed sectional shape which is defined by a relationship of $$2.0 \le \frac{d2}{d1} \le 3.0,$$

and wherein using a first center distance p1 being measured between the obliquely adjacent columns in the width direction of the flat tube and a second center distance p2 being measured between the obliquely adjacent columns in the length direction of the flat tube, the plurality of columns are arranged to meet relationships of $$1.5 \le \frac{p1}{d1} \le 3.0 \text{ and } 0.5 \le \frac{p2}{d2} \le 1.5.$$

* * * * *